United States Patent [19]

Guittet et al.

[11] Patent Number: 4,990,069

[45] Date of Patent: Feb. 5, 1991

[54] MULTI-STAGE ROOTS VACUUM PUMP WITH SEALING MODULE

[75] Inventors: Dominique Guittet, Annecy; Eric Taberlet; Jean-Francois Vuillermoz, both of Annecy-Le Vieux, all of France

[73] Assignee: Societe Anonyme dite: Alcatel Cit, Paris, France

[21] Appl. No.: 432,428

[22] Filed: Nov. 6, 1989

[30] Foreign Application Priority Data

Nov. 7, 1988 [FR] France ..... 88 14494

[51] Int. Cl.[5] ..... F04C 18/18; F04C 27/00; F04C 25/02

[52] U.S. Cl. ..... 418/9; 418/104; 418/141; 277/55

[58] Field of Search ..... 418/9, 10, 104, 83, 418/141; 277/2, 3, 55, 56

[56] References Cited

U.S. PATENT DOCUMENTS

| | | | |
|---|---|---|---|
| 937,916 | 10/1909 | Bentley | 277/56 |
| 4,657,495 | 4/1987 | Sakamaki et al. | 418/104 |
| 4,789,314 | 12/1988 | Higuchi et al. | 418/83 |

FOREIGN PATENT DOCUMENTS

| | | | |
|---|---|---|---|
| 252889 | 11/1986 | Japan | 418/9 |
| 2089892 | 6/1982 | United Kingdom . | |
| 2116634 | 9/1983 | United Kingdom . | |

*Primary Examiner*—John J. Vrablik
*Assistant Examiner*—David L. Cavanaugh
*Attorney, Agent, or Firm*—Sughrue, Mion, Zinn, MacPeak & Seas

[57] ABSTRACT

A multistage Roots-type vacuum pump comprising: a rotor defining a plurality of successive compression chambers (5) which are axially separated from one another by intermediate plates (1); a rotor assembly disposed inside the stator and constituted by two parallel shafts (8, 9) supported by bearings (11, 12) in end plates (2, 3) of the stator, each shaft (8, 9) being fitted inside each chamber (5) with a compression lobe (13, 14) such that each chamber thus contains two conjugate compression lobes; a motor (15) for driving one (8) of the two shafts in rotation, with the other shaft being driven in the opposite direction by gearing (17–18) situated in a housing (6) fixed to the corresponding end plate (2) of the stator, with each of the shafts passing through the end plate via a corresponding lip seal (19, 20); wherein a sealing module (24) is interposed between the end plate (2) situated adjacent to the housing (6) and the compression chamber adjacent to the housing, the module (24) comprising a partition around each of the shafts (8, 9) and fitted with the fixed portion (25, 26) of a corresponding labyrinth seal, with each shaft being provided with the moving complementary portion (27, 28) of the labyrinth seal, the moving portions of the labyrinth seals being situated in a common cavity (31) of the module, which cavity is connected via a non-return valve (32, 33) to the delivery channel (23) from the compression chamber adjacent to the housing, the valve allowing fluid to flow from the cavity (31) into the delivery channel.

3 Claims, 3 Drawing Sheets

MULTI-STAGE ROOTS VACUUM PUMP WITH SEALING MODULE

The present invention relates to a multistage Roots-type vacuum pump: comprising a rotor defining a plurality of successive compression chambers which are axially separated from one another by intermediate plates; a rotor assembly disposed inside the stator and constituted by two parallel shafts supported by bearings in end plates of the stator, each shaft being fitted inside each chamber with a compression lobe such that each chamber thus contains two conjugate compression lobes; a motor for driving one of the two shafts in rotation, with the other shaft being driven in the opposite direction by gearing situated in a housing fixed to the corresponding end plate of the stator, with each of the shafts passing through said end plate via a corresponding lip seal.

BACKGROUND OF THE INVENTION

In a pump of this type, there is an oil seal between the compression lobes and the compression chambers, and the pump is said to be "dry". However, the housing in which the gearing is situated contains oil to lubricate the gearing, and although the housing is separated from the nearest compression chamber by a lip seal around each shaft, the resulting sealing is insufficient when such a pump is used as a primary pump in which the compression chambers should be absolutely free from oil.

Depending on the suction pressure of the pump, the pressure in the compression chamber nearest to the housing, i.e. the chamber constituting the high pressure stage, may be greater than the pressure in the housing, giving rise to the danger that the lip of the lip seal will be raised.

In order to remedy this problem, it would be possible to balance the pressure on either side of the seal by providing a communication duct between the housing and the compression chamber, however that would run the risk of facilitating a flow of oil vapor via said duct from the housing into the compressive chamber, thereby leading to traces of oil condensation in the compression chamber.

The use of a seal having two lips mounted in opposite directions is also to be avoided, since the lip adjacent to the compression chamber cannot be lubricated and will therefore wear, giving rise to a very short lifetime.

In addition, the compression chamber adjacent to the housing runs very hot because of the gas compression, and this high temperature is transmitted to the oil, thereby firstly reducing its viscosity thus increasing leakage, and secondly increasing oil vaporization and making vapor trapping more difficult.

Finally, if the gases being pumped are corrosive, they can damage the seal rapidly and give rise to leaks.

The object of the present invention is to remedy these drawbacks.

SUMMARY OF THE INVENTION

The present invention provides a multistage Roots-type vacuum pump of the type defined above, in which a sealing module is interposed between the said end plate situated adjacent to said housing and the compression chamber adjacent to said housing, said module comprising a partition around each of the shafts and fitted with the fixed portion of a corresponding labyrinth seal, with each shaft being provided with the moving complementary portion of the labyrinth seal, said moving portions of the labyrinth seals being situated in a common cavity of said module, which cavity is connected via a non-return valve to the delivery channel from said compression chamber adjacent to said housing, said valve allowing fluid to flow from said cavity into said delivery channel.

The said sealing module may include a cooling water circulation chamber.

Small quantities of an inert gas may be injected into said cavity.

BRIEF DESCRIPTION OF THE DRAWINGS

An embodiment of the invention is described by way of example with reference to the accompanying drawings, in which.

DETAILED DESCRIPTION

Figure 1:
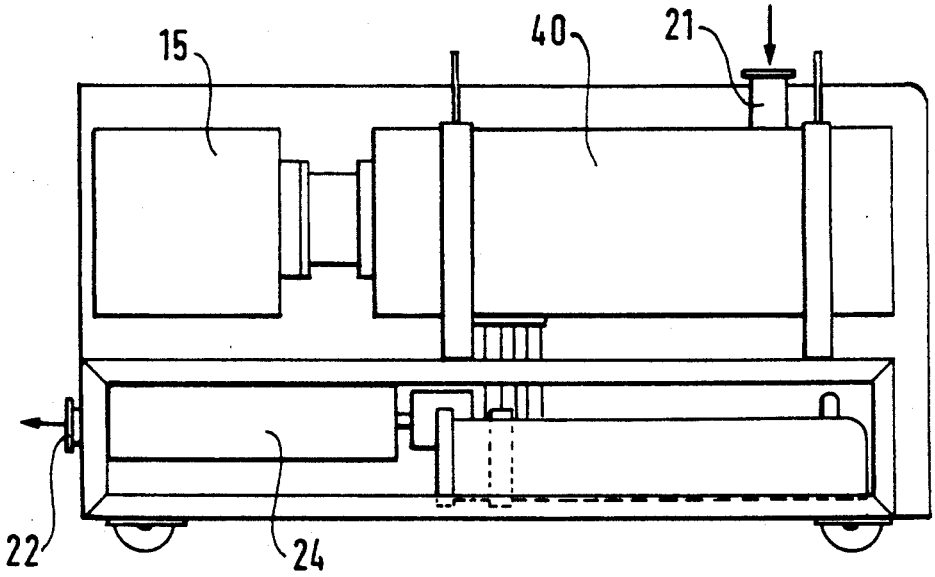
FIG. 1 is a highly diagrammatic outside view of a vacuum pump of the invention.

A multistage Roots type vacuum pump is shown in the figures.

This pump 40 comprises a stator and a rotor assembly. The stator is made by assembling a stack of slices comprising end plates 2 and 3, intermediate plates 1, and stator rings 4. The stator thus defines a plurality of successive compression chambers 5 which are radially delimited by the stator rings, and axially delimited by the plates. The ends of the stator are closed by two covers 6 and 7.

The rotor assembly disposed inside the stator comprises two parallel shafts 8 and 9 carried by ball bearings 11 and 12 in the end plate 2 and also in the end plate 3.

In each compression chamber, the shaft 8 is fitted with a compression lobe 13 and the shaft 9 is fitted with a compression lobe 14. Each compression chamber 5 thus receives two compression lobes: 13 and 14. These lobes have conjugate profiles and are well known per se.

The shaft 8 is rotated by a drive motor 15 via a coupling device 16. The shaft 9 is rotated in the opposite direction by gearing comprising a gear wheel 17 mounted on the shaft 8 and the gear wheel 18 mounted on the shaft 9. This gearing 17–18 is situated inside the cover 6 which constitutes a housing. This housing-cover 6 is fixed to end plate 2. In operation, the housing 6 contains oil for lubricating the gearing 17–18.

The shaft 8 passes through the end plate 2 via a lip seal 19, and similarly the shaft 9 passes the end plate 2 via a lip seal 20.

Figure 2:
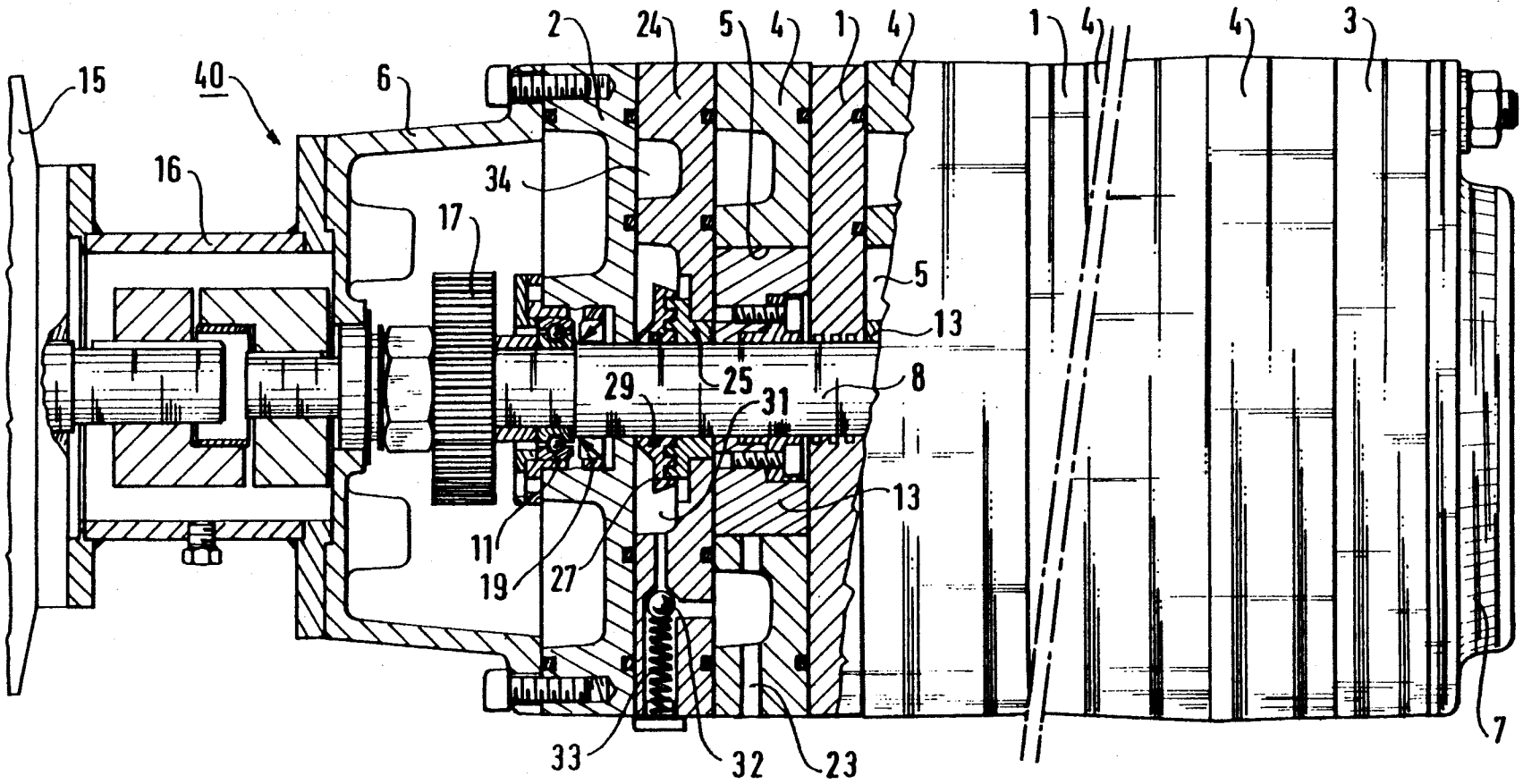
FIG. 2 is an elevation view of the pump of the invention in partial section.
Figure 3:
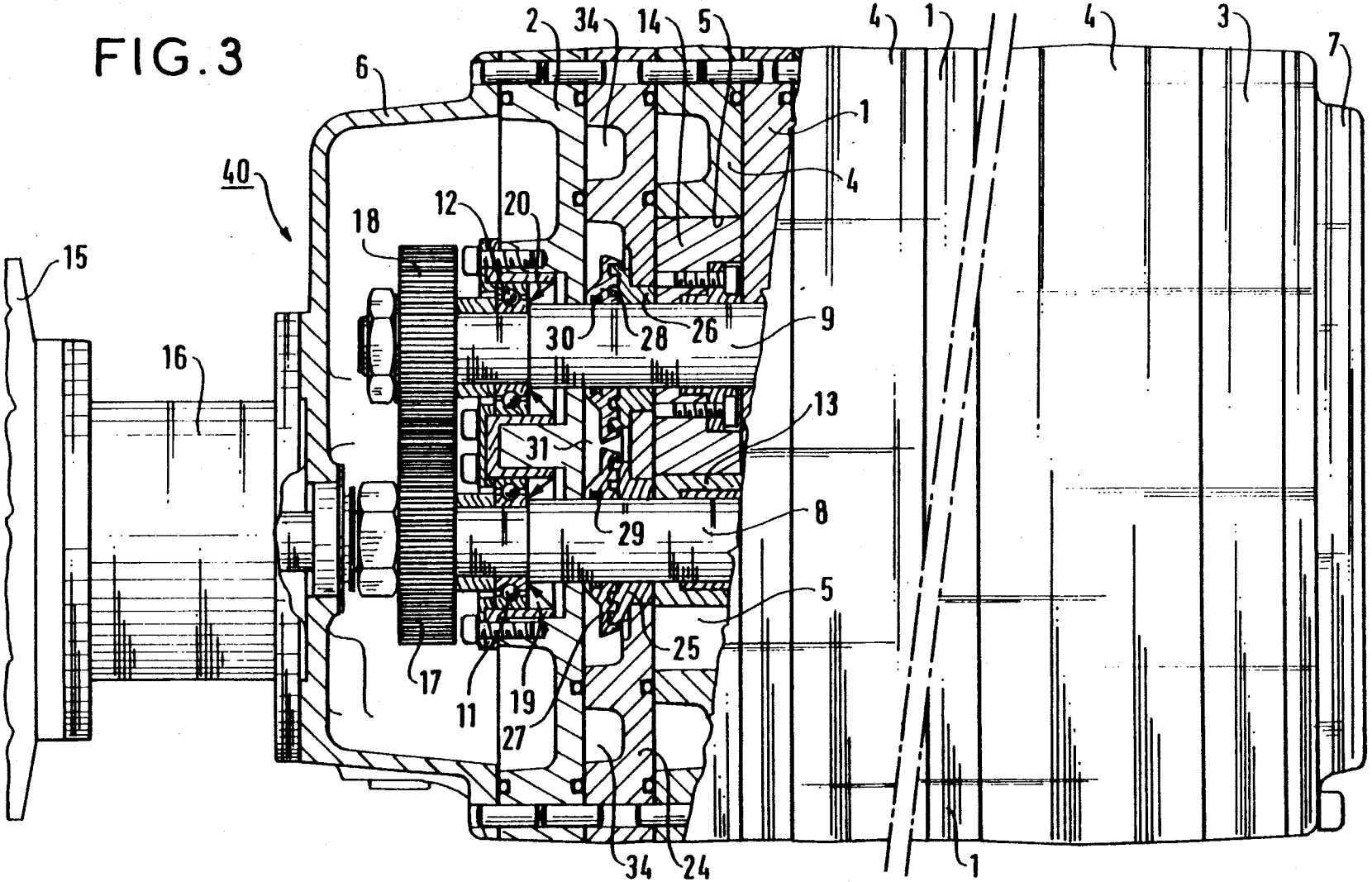
FIG. 3 is a plan view of the pump of the invention as seen from above and in partial section.

FIG. 1 shows a suction inlet 21 and a delivery outlet 22 connected to the delivery channels 23 (FIG. 2) via various members including a silencer 24. The delivery channel 23 passes through the last stator ring 4 situated adjacent to the housing 6. The high pressure end which is at atmospheric pressure under steady conditions is therefore situated adjacent to the gearing 17–18.

When the pump is started, excess pressure is generated in the downstream compression chambers with the pump acting as a compressor having a compression ratio. Thus, when suction 2 begins at atmospheric pressure, the pressure in the last chamber 5 may be considerably higher than the atmospheric pressure existing in the housing 6, and if countermeasures were not provided, this would cause the lips of the seals 19 and 20 to be raised.

Thus, in accordance with the invention, a sealing module 24 is interposed between the end plate 2 and the last compression chamber 5 i.e. between the end plate 2 and the last stator ring 4 closest to the housing 6.

This sealing module 24 is constituted by a partition having the shafts 8 and 9 passing therethrough, with the partition around each shaft being fitted with the fixed portion 25, 26 of a labyrinth seal, while the complementary moving portion 27, 28 of the seal is carried by the corresponding shaft 8 or 9. The moving portions 27 and 28 of the labyrinth seals are mounted on the shafts by means of O-rings 29, 30 and they are situated in a common cavity 31 of the module.

This common cavity 31 is connected to the delivery channel 23 via a valve constituted by a ball 32 biased by a spring 33.

Thus, if there is excess pressure in the common cavity 31, it is put into communication with the delivery channel 23. There is therefore no longer any risk of the lip seal 19 being raised.

The sealing module 24 also includes a chamber 34 for the circulation of cooling water. This circulation serves to remove heat generated in the adjacent compression chamber, and to keep the oil in the housing 6 at ambient temperature. This thus constitutes a thermal barrier. The water delivery and removal ducts are not shown in the drawings.

A small quantity of an inert gas such as nitrogen is also injected into the common cavity 31 so as to dilute any corrosive gas that may be sucked into it, thereby preventing the lip seal 19 from being attacked and destroyed.

The sealing module 24 also acts as an oil trap: if oil should leak via the lip seals 19 and 20 in the form of a vapor, the moving parts 27 and 28 of the labyrinth seals act as deflectors projecting the vapor against the cold wall where it condenses. If the leak is in the form of a liquid, then the sealing rings 29 and 30 prevent the oil from seeping along the shafts. The oil is collected in the common cavity 31 and may be removed therefrom via a bleed hole.

Although this does not form part of the invention, each compression chamber naturally includes an inlet and an outlet, and the outlet of one chamber is connected to the inlet of the following chamber by passing through channels in the intermediate plates 1. These arrangements are conventional and are omitted from the drawings in order to avoid overcrowding.

I claim:

1. In a multistage Roots-type vacuum pump comprising:

a stator defining a plurality of successive compression chambers which are axially separated from one another by intermediate plates and terminating in a high pressure compression chamber at delivery pressure;

a rotor assembly disposed inside the stator and constituted by two parallel shafts supported by bearings in end plates of the stator, each shaft being fitted inside each chamber with a compression lobe such that each chamber thus contains two conjugate compression lobes;

a motor for driving one of the two shafts in rotation, with the other shaft being driven in the opposite direction by gearing situated in a housing fixed to the corresponding end plate of the stator with said high pressure compression chamber at delivery pressure being proximate to said housing situating said gearing, and with each of the shafts passing through said end plate via a corresponding lip seal;

the improvement wherein a sealing module is interposed between the said end plate situated adjacent to said housing and the high pressure compression chamber adjacent to said housing, said module comprising a partition around each of the shafts and fitted with the fixed portion of a corresponding labyrinth seal, with each shaft being provided with the moving complementary portion of the labyrinth seal, said moving portions of the labyrinth seals being situated in a common cavity of said module, said cavity being connected via a non-return valve to the delivery channel from said high pressure compression chamber adjacent to said housing, whereby said valve allows fluid to flow from said cavity into said delivery channel to prevent migration of oil passing via said lip seal into the cavity from reaching said high pressure compression chamber.

2. A vacuum pump according to claim 1, in which said sealing module includes a chamber for the circulation of cooling water.

3. A vacuum pump according to claim 1, in which a small quantity of inert gas is injected into said common cavity.

* * * * *